United States Patent [19]

Shibuya et al.

[11] Patent Number: 4,854,905

[45] Date of Patent: Aug. 8, 1989

[54] METHOD OF FIXING A COLOR SCREENING STRUCTURE FOR A COLOR PICTURE TUBE

[75] Inventors: Kiminobu Shibuya, Saitama; Kenichiro Takayanagi, Aichi, both of Japan

[73] Assignee: Sony Corporation, Tokyo, Japan

[21] Appl. No.: 243,505

[22] Filed: Sep. 12, 1988

[30] Foreign Application Priority Data

Sep. 30, 1987 [JP] Japan ..... 62-246971

[51] Int. Cl.[4] ..... H01J 29/07

[52] U.S. Cl. ..... 445/30; 219/121.64

[58] Field of Search ..... 445/30, 37; 219/121.14, 219/121.64

[56] References Cited

U.S. PATENT DOCUMENTS 4,130,919 12/1978 Iyama ..... 445/30

FOREIGN PATENT DOCUMENTS 1089 1/1980 Japan ..... 445/30

2140969 12/1984 United Kingdom .

*Primary Examiner*—Kenneth J. Ramsey

*Attorney, Agent, or Firm*—Hill, Van Santen, Steadman & Simpson

[57] ABSTRACT

A method of fixing a color screening structure for a color picture tube to the faceplate of the color picture tube, comprising steps of mounting the color screening structure on the faceplate with the through holes formed in first, second and third supporting spring plates attached respectively to a lateral side frame and opposite side frames respectively receiving first, second and third metallic pins attached respectively to three sides of the faceplate, welding the first supporting spring plate to the first metallic pin at a plurality of weld points in a predetermined welding sequence by laser welding, and alternately welding the second and third supporting spring plates respectively to the second and third metallic pins at a plurality of weld points in a predetermined welding sequence by laser welding.

4 Claims, 9 Drawing Sheets

METHOD OF FIXING A COLOR SCREENING STRUCTURE FOR A COLOR PICTURE TUBE

BACKGROUND OF THE INVENTION

1. Field of the Invention

The present invention relates to a method of fixing a color screening structure for a color picture tube.

2. Description of the Prior Art

A color picture tube comprises, as shown in FIGS. 9 and 10, a tube body 1 having a faceplate 1P provided over the inner surface thereof with a color fluorescent screen 3, electron guns 4, and a color screening structure 5, such as an aperture grill or a shadow mask, mounted just back of the color fluorescent screen 3 to ensure that each of the electron beans produced by the electron guns 4 strikes only its intended color phosphor dots in the color fluorescent screen 3. The color screening structure 5 comprises a frame 6 consisting of a pair of parallel frame members **6*a* and 6*b* extending opposite to each other,and side frame members 6*c* and 6*d* extending in parallel to each other so as to interconnect the frame members 6*a* and 6*b* , and a grid member 7 provided with a plurality of slits and extended across the frame members 6*a* and 6*b* on the side of the frame 6 facing the color fluorescent screen 3. Supporting spring plates 7A, 7B and 7C provided respectively with through holes 8 are welded respectively to the frame member 6*a* and the side frame members 6*c* and 6*d* of the frame 6. The color screening structure 5 is mounted on the tube body 1 with the through holes 8 of the supporting spring plates 7A, 7B and 7C receiving pins 9A, 9B and 9C, respectively, attached to the inner surface of the skirt of the faceplate 1P**.

A method of fixing the supporting spring plates 7A, 7B and 7C respectively to the pins 9A, 9B and 9C formed of a metal through laser welding has been proposed to prevent the color screening structure 5 from being dislocated when shocks are applied to the color picture tube, namely, to improve the shock resistance of the color screening structure 5. However, this proposed method has a serious problem that the supporting spring plates 7A, 7B and 7C and the pins 9A, 9B and 9C are melted partly during laser-welding process and contract when cooled after welding, so that the supporting spring plates 7A, 7B and 7C are dislocated relative to the pins 9A, 9B and 9C to dislocate the color screening structure 5 relative to the faceplate 1P.

On the other hand, the color fluorescent screen 3 of the color picture tube is formed by optical means while the faceplate 1P and the color screening structure 5 are held in a fixed positional relation. Therefore, although the color picture tube having the color screening structure attached to the tube body by welding the supporting spring plate 7A, 7B and 7C to the pins 9A, 9B and 9C has excellent shock resistance, it is possible that the color screening structure is misaligned with the faceplate 1P, hence, with the color fluorescent screen 3, at the completion of manufacture and hence electron beams strike wrong color phosphor dots to cause so-called chromatic misalignment. Such a color picture tube is unacceptable.

Japanese Utility Model Publication No. 60-15241 discloses a method of fixing the supporting spring plates to the metallic pins. In this known method, a supporting spring plate 7 is provided with a hexagonal through hole 8 formed in a shape to receive a metallic pin 9 therethrough so that the metallic pin 9 is in contact with every other side of the hexagonal through hole 9 and the supporting spring plate 7 and the metallic pin 9 are welded together by spot welding at the sides q1, q2 and q3 of the hexagonal through hole 8 which are not in contact with the metallic pin 9 as shown in FIG. 11. This known method, however, has practical problems that the gaps between the sides q1, q2 and q3 and the metallic pin 9 must be very small, for example, 0.3 mm or less, to enable satisfactory spot welding, that, in some cases, the sides q1, q2 and/or q3 of the hexagonal through hole 8 which must be separated from the metallic pin 9 is in contact with the metallic pin 9 and that misalignment of the color screening structure can occur due to heating the metallic pin 9 and the supporting spring plate 7 in welding causing the dislocation of the supporting spring plate 7 relative to the metallic pin 9. These problems have become more and ore serious with the progressive improvement of the precision of the color picture tube.

SUMMARY OF THE INVENTION

Accordingly, it is an object of the present invention to provide a method of fixing a color screening structure for a color picture tube, capable of fixing the supporting spring plates of a color screening structure by laser welding to metallic pins attached to the skirt of a faceplate for a color picture tube and suppressing the dislocation of the color screening structure relative to the faceplate of the color picture tube attributable to laser welding to the least extent.

A method of fixing a color screening structure to the faceplate of a color picture tube, according to the present invention is based on findings obtained through empirical studies by the inventors of the present invention that, in fixing supporting spring plates of a color screening structure respectively to metallic pins attached to the faceplate of a color picture tube by laser welding, there exists a fixed relation between weld position, the direction of movement of the color screening structure, depth of penetration and the distance of movement of the color screening structure and that the position of the color screening structure can correctly be adjusted relative to the faceplate by controlling the welding sequence and depth of penetration, so that the movement of the color screening structure relative to the faceplate attributable to welding can be restricted to the least extent.

BRIEF DESCRIPTION OF THE DRAWINGS

The above and other objects, features and advantages of the present invention will become apparent from the following description taken in conjunction with the accompanying drawings, in which.

DETAILED DESCRIPTION OF THE PREFERRED EMBODIMENT

Figure 1:
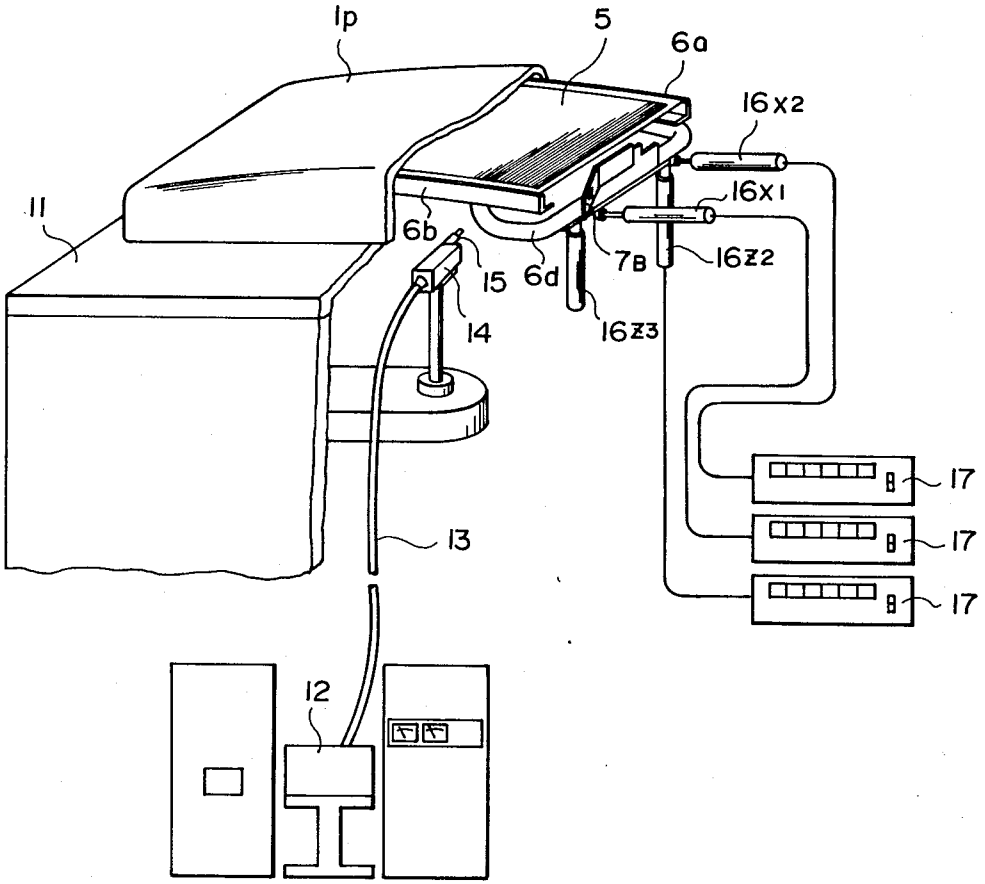
FIG. 1 is a partly cutaway schematic perspective view showing the constitution of a laser welding equipment for carrying out the present invention.
Figure 2:
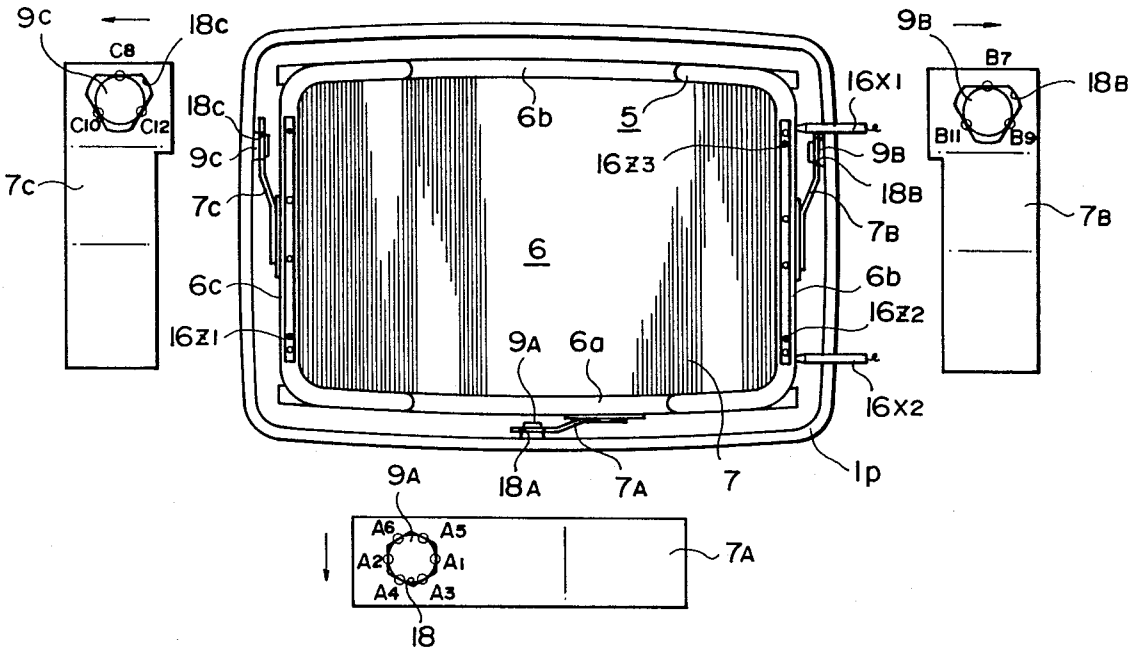
FIGS. 2 and 3 are a rear elevation and a side elevation, respectively, of an assembly of a color screening structure and the faceplate of a color picture tube assembled by a method of fixing a color screening structure, in a preferred embodiment, according to the present invention.

Referring to FIG. 1, a color screening structure 5 is disposed opposite the inner surface of a face plate 1P provided with a color fluorescent screen over the inner surface thereof. The face plate 1P and the color screening structure 5 are held on a table 11. A laser beam emitted by a laser unit 12 is transmitted through an optical fiber cable 13 to a lens unit 14. The lens unit 14 focuses the laser beam on a weld position. A magnetic position detector 15 is incorporated into the lens unit 14 to detect the centers of pins. Five magnetic scales 16 ($16_{x1}$, $16_{x2}$, $16_{z1}$and $16_{z3}$) are provided to control the distance of movement of the color screening structure 5. The magnetic scales $16_{x1}$ and $16_{x2}$ are disposed in contact with the side surface of the side frame member 6*d* of the frame 6 of the color screening structure 5 respectively at two different positions to measure the distance of movement of the color screening structure 5 with respect to an X direction, the magnetic scales $16_{z1}$ and $16_{z2}$ are disposed in contact with the lower surface of the side frame member 6*d* of the frame 6 respectively at two different positions to measure the distance of movement of the color screening structure 5 with respect to a Z direction (a direction along the axis of the color picture tube), and the magnetic scale $16_{z3}$ is disposed in contact with the lower surface of the other side frame member 6*c* of the frame to measure the distance of movement of the color screening structure 5 with respect to the Z direction as shown in FIG. 2. Values measured by the five magnetic scales 16 are indicated respectively on counters 17. In FIG. 1, only the counters 17 for the magnetic scales $16_{x1}$, $16_{x2}$ *and* $16_{z2}$ are shown and the counters 17 for the rest of the magnetic scales are not shown.

Figure 3:
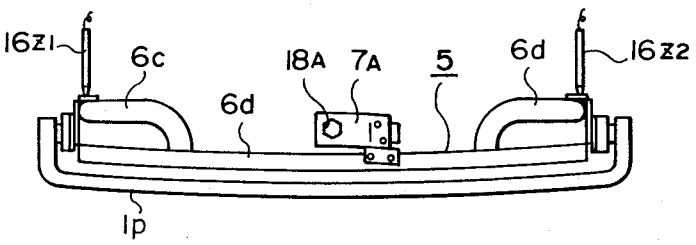

As shown in FIGS. 2 and 3, the color screening structure 5 comprises a frame 6 consisting of a pair of opposite, parallel frame members 6*a* and 6*b* and the pair of opposite, parallel side frame members 6*c* and 6*d* extending across the frame members 6*a* and 6*b* and interconnecting the frame members 6*a* and 6*b* , a grid member 7 having a plurality of slits and extended between the opposite frame members 6*a* and 6*b* , and supporting spring plates 7 (a first supporting spring plate 7A, a second spring plate 7B and a third supporting spring plate 7C) welded respectively to the frame member 6*a* and the side frame members 6*c* and 6*d*. The supporting spring plates 7 are provided respectively with through holes 18 (18A, 18B and 18C) respectively for engaging metallic pins 9 (9A, 9B and 9C) attached to the inner surface of the faceplate 1P. The through hole 18A of the first supporting spring plate 7A, in particular, is a hexagonal hole having two opposite sides extending in parallel to the direction of the width of the first supporting spring plate 7A. The first supporting spring plate 7A is in point contact with the metallic pin 9A at three weld points $A_1$, $A_4$ and $A_6$ respectively on the three alternate sides of the hexagonal through hole 18A to locate the color screening structure 5 at a correct position relative to the faceplate 1P. The three weld points $A_1$, $A_4$ and $A_6$ are distributed at regular angular intervals of 120° . The other alternate three sides of the hexagonal through hole 18A are spaced apart from the metallic pin 9A by a fixed small gap respectively at three weld points $A_2$, $A_3$ and $A_5$ which are distributed at regular angular intervals of 120° . The through holes 18B and 18C of the second supporting spring plate 7B and the third supporting spring plate 7C are substantially triangular holes. The second supporting plate 7B and the third supporting spring plate 7C are in point contact with the corresponding metallic pins 9B and 9C respectively at three weld points $B_7$, $B_9$ and $B_{11}$ and three weld points $C_8$, $C_{10}$ and $C_{12}$, which are distributed at regular angular intervals of 120° . The metallic pin 9A is attached to the middle of the lower side of the faceplate 1P, while the metallic pins 9B and 9C are attached to the two opposite sides, namely, the right side and the left side, of the faceplate 1P symmetrically with respect to the vertical center axis, as viewed in FIG. 2, of the faceplate 1P.

Figure 8:
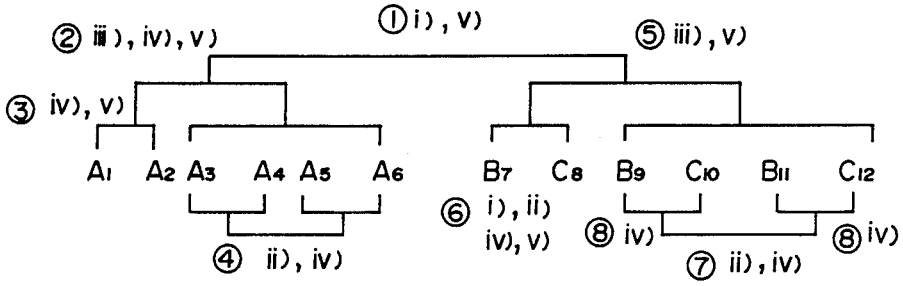
FIG. 8 is a diagram showing steps of a welding procedure according to the present invention.
Figure 9:
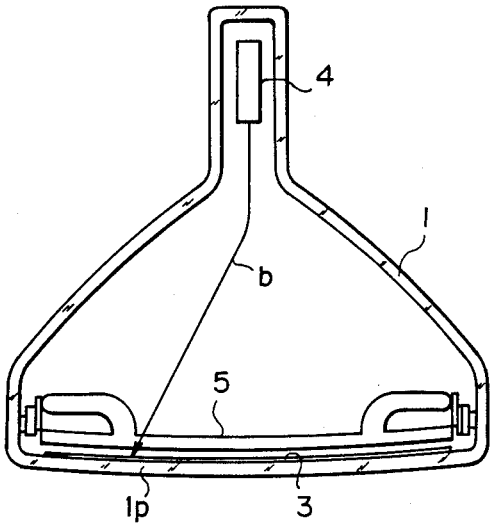
FIGS. 9 and 10 are a schematic sectional view and an internal rear elevation, respectively, of a color picture tube.
Figure 10:
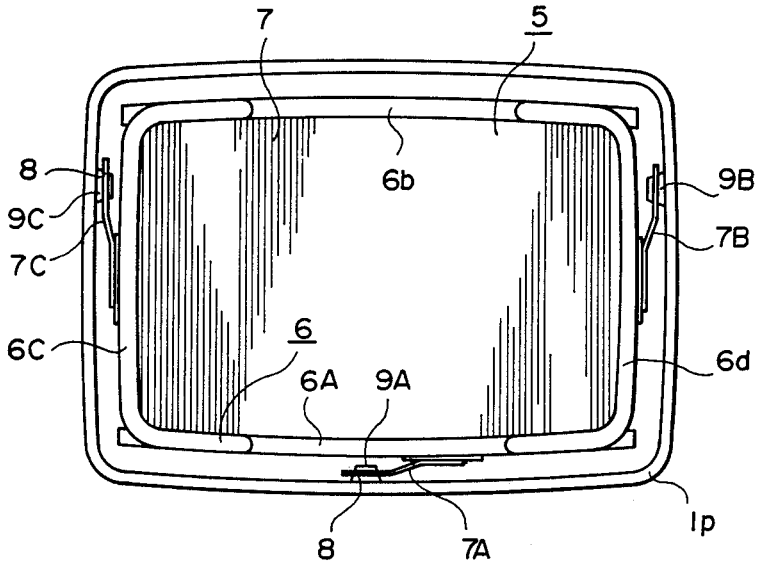
Figure 11:
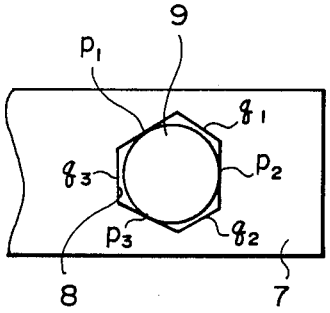
FIG. 11 is a plan view of assistance in explaining a metallic pin and a supporting spring plate in a conventional color picture tube.

The color fluorescent screen is formed over the inner surface of the faceplate 1P. The color screening structure 5 is fixed to the faceplate 1P opposite to the color fluorescent screen. In fixing the color screening structure 5 to the faceplate 1P, the faceplate 1P is placed on the table 11, the magnetic sensors 15 incorporated into the lens unit 14 are moved in the x directions and in the Z directions to locate the respective centers of the metallic pins 9A, 9B and 9C, the color screening structure 5 is fixedly mounted on the faceplate 1P by receiving the metallic pins 9A, 9B and 9C respectively in the corresponding through holes 18A, 18B and 18C of the supporting spring plates 7A, 7B and 7C, weld positions are located with reference to the centers of the metallic pins 9A, 9B and 9C, and then the supporting spring plates 7A, 7B and 7C are welded by laser welding to the corresponding metallic pins 9A, 9B and 9C. The first supporting spring plate 7A is welded to the first metallic pin 9A at the six weld points $A_1$ through $A_6$, the second supporting spring plate 7B is welded to the second metallic pin 9B at the three weld points $B_7$, $B_9$ and $B_{11}$, and the third supporting spring plate 7C is welded to the third metallic pin 9C at the three weld points $C_8$, $C_{10}$ and $C_{12}$. The supporting spring plates 7A, 7B and 7C are welded to the metallic pins 9A, 9B and 9C in a welding sequence as shown in FIG. 8. First, the first supporting spring plate 7A is welded to the first metallic pin 9A at the weld positions in order of the weld points $A_1$, $A_2$, $A_3$, $A_4$, $A_5$ and $A_6$. Then, the second supporting spring plate 7B and the third supporting spring plate 7C are welded alternately to the second metallic pin 9B and the third metallic pin 9C at the weld positions in order of the weld points $B_7$, $C_8$, $B_9$, $C_{10}$, $B_{11}$ and $C_{12}$. The depth of penetration is controlled according to the welding sequence for laser welding. The final positional deviation of the color screening structure 5 from the correct position, namely, the displacement of the color screening structure 5, is monitored by the counters 17.

The movement of the color screening structure 5 relative to the faceplate 1P during laser welding will be explained to facilitate understanding the present invention.

The distance and direction of movement of the color screening structure 5 during laser welding is greatly dependent on the following two factors.

(1) Depth of penetration (2) Influence of the welded and fixed part, namely, the degree of freedom of movement.

Depth of penetration is dependent on the power density of the laser beam (input voltage, input current, pulse width) and weld position (focusing condition, striking position) and affects weld strength and the displacement of the color screening structure 5. The depth of the nugget is dependent on the power density of the laser beam, while the area of the nugget is dependent on the spot size of the laser beam. Accordingly, the displacement of the color screening structure 5 and the weld strength of the welded parts increase with the input voltage, the pulse width and the power density of the laser beam when the laser beam is defocused within an allowable range. On the contrary, the displacement of the color screening structure 5 can be limited to a small extent by reducing the depth of penetration in the supporting spring plates 7 and the metallic pins 9. The greater the depth of the nugget controlled by reducing the power density and spot size of the laser beam and by dislocating the striking position, the greater the contraction and the displacement of the color screening structure 5 will be. Accordingly, in the method of the present invention, the depth of penetration is small and the area of the nugget is large.

Figure 5:
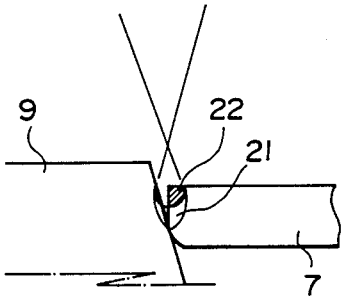
FIGS. 5 to 7 are illustrations of assistance in explaining depth of penetration and direction of movement of of a supporting spring plate during a welding process according to the present invention.

The depth of the nugget can be regulated by controlling the spot size and power density of the laser beam. When the input conditions of the laser welding equipment are fixed, the power density of the laser beam is increased and hence the depth of the penetration is large when the laser beam is in an optimum focus as indicated at 21 in FIG. 5, while the power density of the laser beam is reduced and hence the depth of penetration is small when the laser beam is defocused as indicated at 22 in FIG. 5. It is also possible to increase the depth of penetration by increasing the power density of the laser beam. However, excessive momentary increase in the power density of the laser beam entails increase in the possibility of burn through and increase in spatters.

Figure 6A:
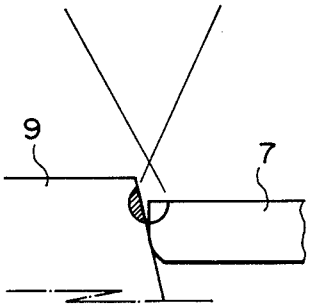
Figure 6B:
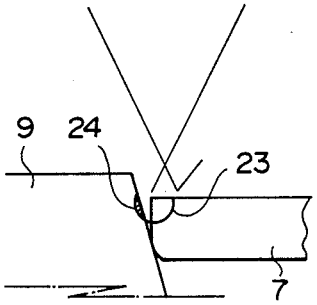

The area of the nugget can be controlled by deviating the striking position of the laser beam. FIG. 6A illustrates an appropriate striking position and FIG. 6B illustrates a deviated striking position. When the striking position of the laser beam is deviated as shown in FIG. 6B, useless penetration 23 increases in the supporting spring plate 7 while insufficient penetration 24 occurs in the metallic pin 9. The depth of penetration 24 in the metallic pin 9 affects the distance of movement of the color screening structure 5.

Since the distance of movement is dependent on the depth of penetration, the distance of movement can be controlled by selectively deciding the weld position, namely, by deviating the striking position to increase useless penetration. The area of the nugget can be controlled by regulating the spot size.

The effect of a fixed point on the direction of movement of the color screening structure 5 will be described hereinafter. Basically, the direction of movement of the color screening structure 5 due to welding coincides with a direction indicated by the arrow F in FIG. 7. However, in practical welding operation, the ratio of the component in the direction of the arrow A and the component in the direction of the arrow B (FIG. 7) varies due to resilient pressure that acts on the weld point and increase in the supporting points and fixed points (welded points). For example, when the supporting plate 7 is welded previously to the metallic pin 9 at the weld points $A_1$ and $A_2$, it is difficult for the weld point $A_3$ to move in the direction of the arrow A. Consequently, the component in the direction of the arrow B increases relative to the component in the direction of the arrow A, and hence the lower left-hand corner, as viewed in FIG. 2, of the color screening structure moves in the $-Z$ direction (a direction directed away from the faceplate 1P) and the lower right-hand corner of the same moves in the $+Z$ direction (a direction directed toward the faceplate 1P). When the first supporting spring plate 7A is welded first at the weld point $A_3$ to the metallic pin 9A, the component in the direction of the arrow A increases relative to the component in the direction of the arrow B, consequently, both the lower right-hand corner and lower left-hand corner of the color screening structure 5 move in the $+Z$ direction.

The reason of the welding sequence ($A_1$ through $C_{12}$) will be described hereinafter.

The sequence and adjustment of welding is decided taking the following five factors into consideration.

(i) Conditions of the supporting system: Arrangement of the supporting spring plates, balance of weight distribution, etc.

(ii) Dependence on external force: Weight of the color screening structure, spring pressure, etc.

(iii) Directionally of movement: Condition whether the directions of the arrows A and B (FIG. 7) are two-dimensional or three-dimensional.

(iv) Effect of the fixed point on the distance of movement of the color screening structure and cancellation between the distances of movement: Estimation of the direction of movement and reduction of the distance of movement.

(v) Requisite criteria of the finished color picture tube: Allowance in the direction of movement and the control of the distance of movement.

The factor (v) concerns the following facts. After the color screening structure has been welded to the faceplate and the faceplate has been connected to the tube body, the assembly of the color screening structure, the face plate and the tube body is subjected to heat treatment at a high temperature in the range of 370° to 430° C. for frit-sealing and evacuation, which causes the dislocation of the color screening structure resulting in faulty beam landing such as twisted landing or figure-8 landing. Since the distances of movement of the color screening structures using parts of the same lot are distributed within a substantially fixed range, it has been usual to correct faulty landing by means of a correction lens in forming the color fluorescent screen. However, in some cases, when the parts are changed for those of another lot, the mode of faulty landing varies. In such a case, it is more simple to change welding conditions for previous backward correction than to change the correction lens.

The welding sequence is decided on the basis of the factors (i) through (v). The steps of the welding sequence will be explained sequentially the reference to FIG. 8 and FIGS. 4A through 4L.

(1) First, the first supporting spring plate 7A is welded to the metallic pin 9A in view of the control of the balance of the three-pin supporting system (factors (i) and (v)).

Figure 7:
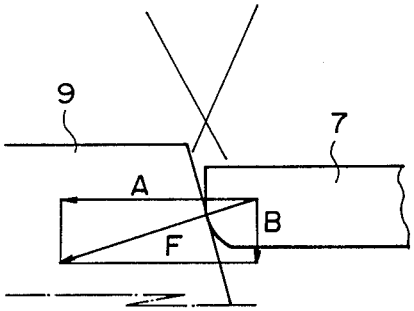

(2) The first supporting spring plate 7A is welded at the weld points $A_1$ and $A_2$ to the metallic pin 9A before being welded at the weld points $A_3$ to $A_6$, because the directionality of movement is two-dimensional (the directions A and B in FIG. 7 are affected little by the Z-component), positional correction in the X direction of the color screening structure in the finished color picture tube is necessary, and the displacement of the first supporting spring plate 7A at the weld points $A_3$ to $A_6$ can be suppressed by fixing the first supporting spring plate 7A to the metallic pin 9A at the weld points at which the directionality of movement of the first supporting spring plate 7A is exactly known (factors (iii), (iv) and (v)).

(3) The first supporting spring plate 7A is welded at the weld point $A_1$ to the metallic pin before welding the same at the weld point $A_2$ to the metallic pin, because the color screening structure must be shifted in the +X direction in the finished color picture tube, the distance of movement at a point welded earliest is greater than those at points welded afterward, and the weld point $A_2$ is separated from the metallic pin and hence it is difficult to control the distance of movement at the weld point $A_2$ unless the first supporting spring plate 7A is fixed at the weld point $A_1$ prior to welding the first supporting spring plate at the weld point $A_2$ and variation in the distance of movement is large at the weld point $A_2$ (factors (iv) and (v)).

(4) The first supporting spring plate 7A is welded to the metallic pin 9A at the weld points $A_3$ and $A_4$ prior to welding the same at the weld points $A_5$ and $A_6$ in consideration of the relation between the direction of movement of the color screening structure and the direction of action of the weight of the color screening structure, and the cancellation between the distances of movement (factors (ii) and (iv)).

(5) The second and third supporting spring plates 7B and 7C are welded respectively to the metallic pins and 9B and 9C at the weld points $B_7$ and $C_8$ prior to welding the same at the weld points $B_9$ to $C_{12}$, because the directionality of movement is two-dimensional, the distance of movement of the second and third supporting spring plates 7B and 7C at the weld points $B_9$ to $C_{12}$ must be suppressed, and the center twist $\theta_2$ in the finished color picture tube must be corrected (factors (iii) and (v)).

(6) The distance of movement of the color screening structure at the weld point $C_8$ is greater than that at the weld point $B_7$ owing to the relation between the supporting system and the spring pressure when a laser beam of the same power is used for welding the second and third supporting spring plates 7B and 7C at the weld points $B_7$ and $C_8$. Accordingly, the welding is carried out in order of $B_7$ and $C_8$ in consideration of cancellation between the distances of movement and the control of the distance of movement (factors (i), (ii), (iv) and (v)).

(7) For the same reason stated in (4), the second and third supporting spring plates 7B and 7C are welded respectively to the metallic pins 9B and 9C at the weld points $B_9$ and $C_{10}$ prior to welding the same at the weld points $B_{11}$ and $C_{12}$ (factors (ii) and (iv)).

(8) Welding order of $B_9$, $C_{10}$, $B_{11}$ and $C_{12}$ enables cancellation between the distances of movement. The second supporting spring plate 7B and the third supporting spring plate 7C are welded alternately to prevent the change in the engagement of one of the second and third supporting spring plates 7B and 7C with the corresponding metallic pin due to completion of welding of the other supporting spring plate before welding the former, because the completion of welding of one of the supporting spring plates 7B and 7C induces such an adverse change in the engagement of the other supporting spring plate with the corresponding metallic pin (factor (iv)).

FIGS. 4A through 4L show measured data representing the movement of the color screening structure when the color screening structure is fixed to the faceplate by welding the supporting spring plates to the corresponding metallic pins in the foregoing welding sequence, in which the movement of the color screening structure is shown qualitatively. In FIGS. 4A through 4L, the measured deviation (the distance of movement) of six points on the color screening structure respectively corresponding to six reference points $0_1$, $O_2$, $O_3$, $O_4$, $O_5$ and $O_6$ on the surface of the faceplate 1P in the X directions (directions parallel to the surface of the faceplate 1P) and the Z directions (directions perpendicular to the surface of the faceplate 1P) is indicated with respect to the six reference points $O_1$ to $O_6$. The arrow f attached to the weld point indicates the direction of movement which is dependent on the component in the direction A (FIG. 7), the arrow indicates the direction of rotation which is dependent on the component in the direction of the arrow B (FIG. 7) (the rotative component of the supporting spring plate).

Figure 4A:
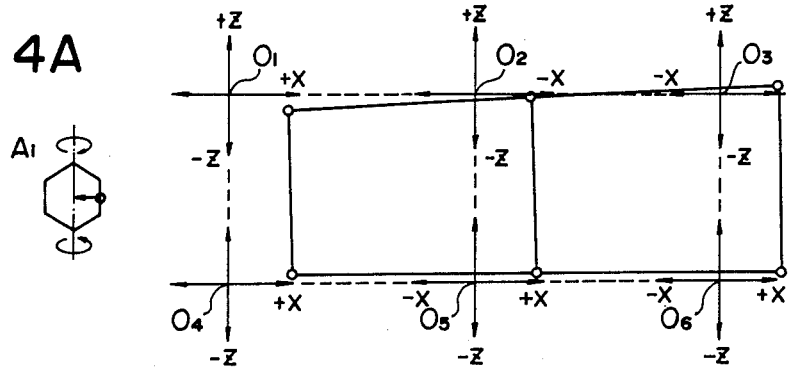
FIGS. 4A to 4L are diagrammatic illustrations showing the movement of a color screening structure at different stages of welding procedure according to the present invention.
Figure 4B:
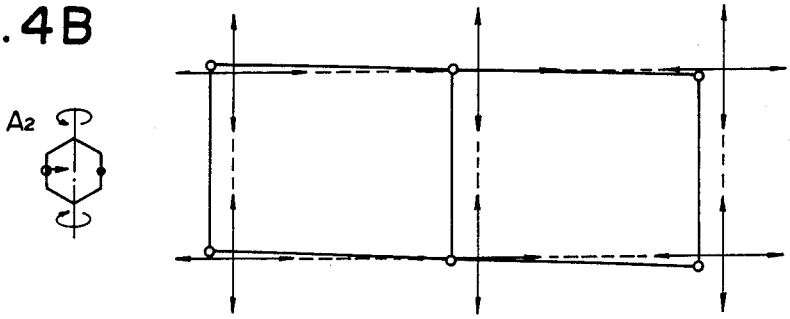
Figure 4C:
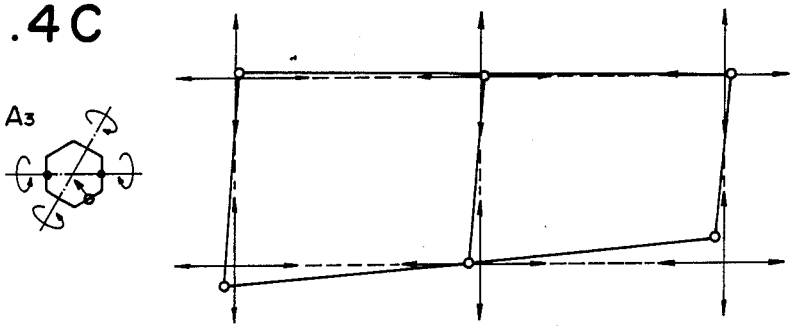
Figure 4D:
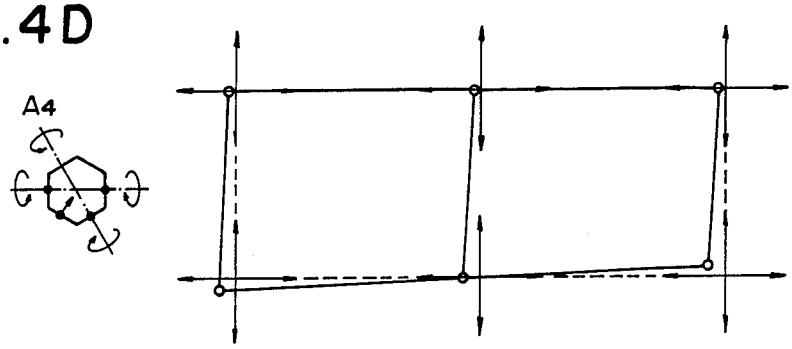
Figure 4E:
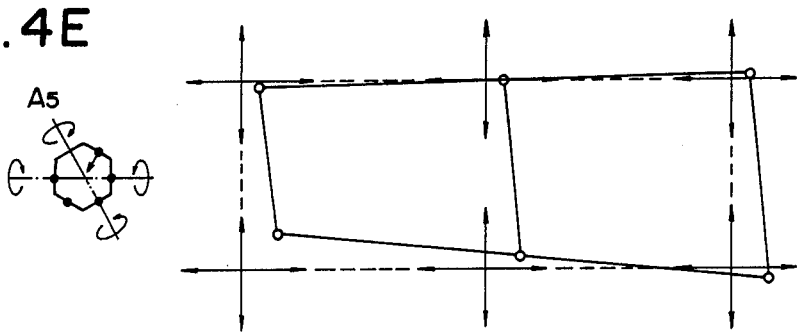
Figure 4F:
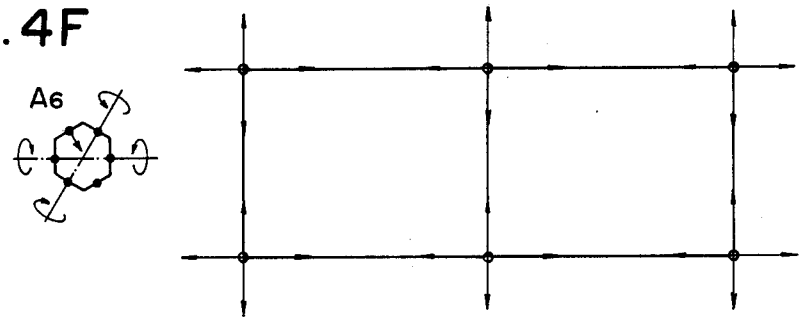
Figure 4G:
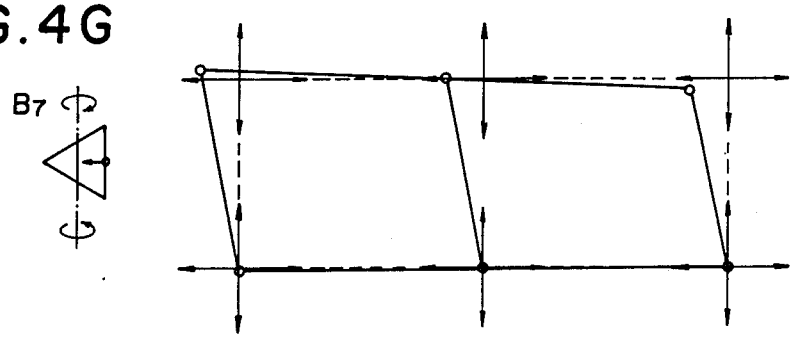
Figure 4H:
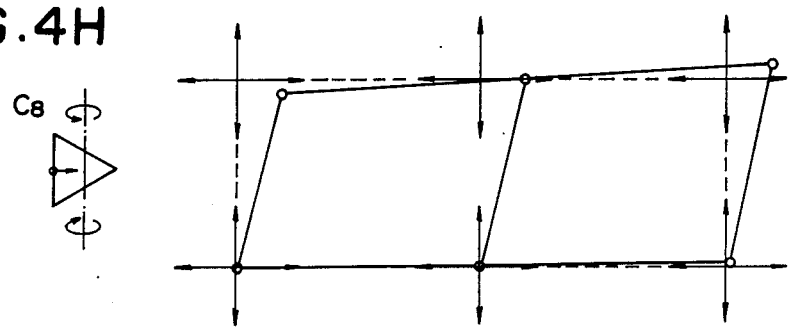
Figure 4I:
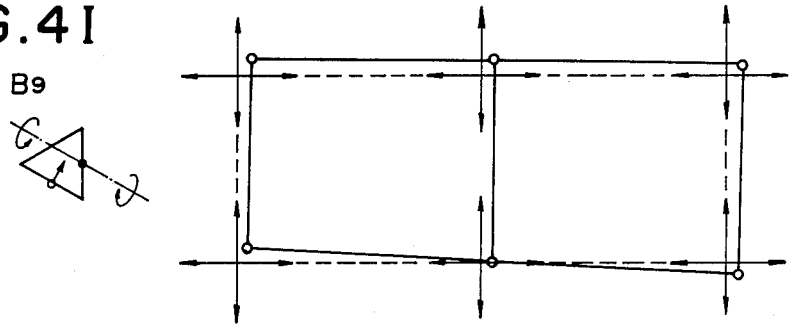
Figure 4J:
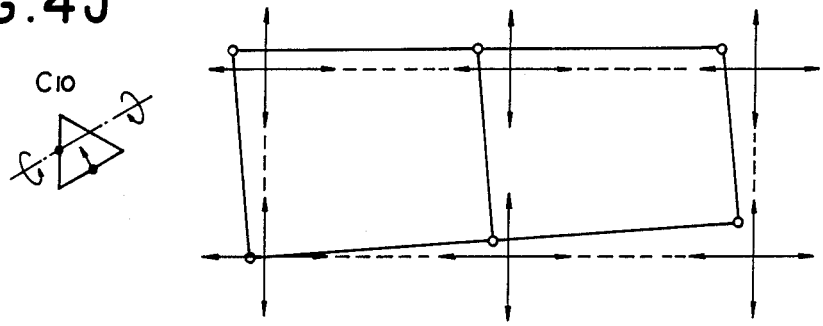
Figure 4K:
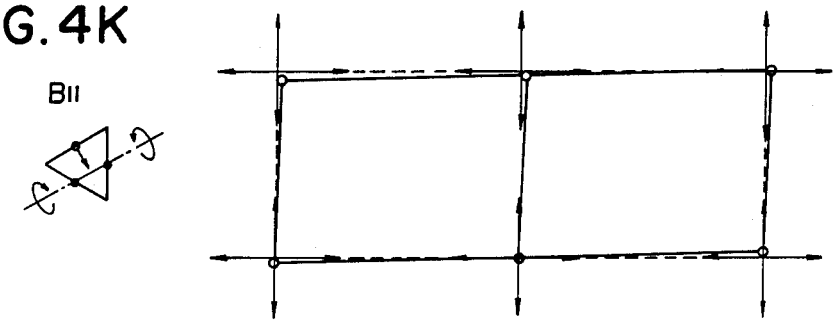
Figure 4L:
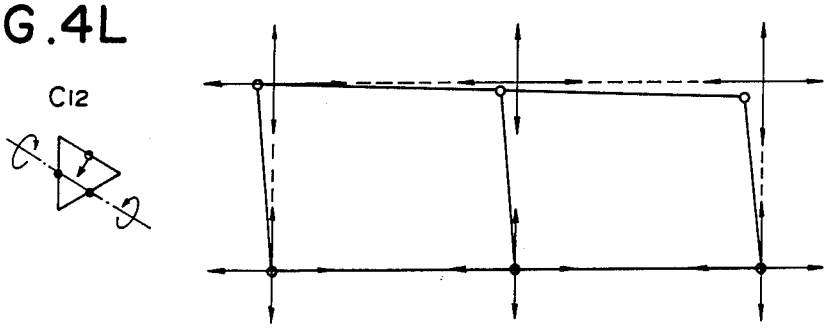

As is obvious from FIG. 4F, at the completion of welding the first supporting spring plate 7A to the first metallic pin 9A at the weld point $A_6$, the color screening structure is aligned correctly with the color fluorescent screen and, at the end of the welding of the third supporting spring plate 7C to the third metallic pin 9C at the weld point $C_{12}$, namely, at the completion of alternately welding the supporting spring plates 7B and 7C respectively to the second metallic pin 9B and the third metallic pin 9C, the color screening structure is dislocated very slightly relative to the color fluorescent screen.

Thus, the method of the present invention welds the supporting spring plates 7A, 7B and 7C respectively to the metallic pins 9A, 9B and 9C by using the laser welding equipment shown in FIG. 1, according to fixed optimum conditions determined on the basis of measured data for the depth of penetration appropriate to the foregoing welding sequence to mass-produce color picture tubes. During the mass production of color picture tubes, the depth of penetration can be controlled by measuring the position of each color screening structure by the magnetic scales every welding operation for welding the supporting spring plate to the pin at each weld point, and processing the measured position of the color screening structure by the computer.

The method of fixing a color screening structure of the present invention is capable of fixing a color screening structure of a three-pin system to a faceplate with the least deviation of the color screening structure from the correct position relative to the color fluorescent screen formed in the inner surface of the faceplate by welding the supporting spring plates 7A, 7B and 7C respectively to the metallic pins 9A, 9B and 9C in the special welding sequence and controlling the depth of penetration. Furthermore, the method of the present invention is able to correct faulty landing, such as twist or figure-8, simply by changing the welding conditions instead of changing the correction lens. Consequently, the shock resistance of the color picture tube is improved, faulty landing is reduced and the yield of color picture tubes is improved.

As apparent from the foregoing description, according to the present invention, in fixedly mounting the color screening structure of a three-pin supporting system on the faceplate by welding the supporting spring plates engaging respectively with the metallic pins attached to the faceplate to the metallic pins by laser welding, the color screening structure can be fixed to the faceplate with the least resultant deviation by controlling the depth of penetration, first welding the first supporting spring plate attached to the middle of one of the frame members of the color screening structure to the first metallic pin and alternately welding the second and third supporting spring plates attached respectively to the opposite side frame members respectively to the second and third metallic pins at the weld points. Thus, the present invention improves the shock resistance of the color screening structure, reduces faulty landing and improves the yield of the product. The present invention is particularly effective when applied to manufacturing super precision color picture tubes.

Although the invention has been described in its preferred form with a certain degree of particularity, obviously many changes and variations are possible therein. It is therefore to be understood that the present invention may be practiced otherwise than specifically described herein without departing from the scope and spirit thereof.

What is claimed is:

1. A method of fixing a color screening structure having first, second and third supporting spring plates, for a color picture tube, comprising steps of:

mounting the color screening structure on the faceplate of a color picture tube with polygonal through holes formed respectively in the first, second and third supporting spring plates respectively receiving first, second and third metallic pins attached to the middle of a lateral side, one of the right and left sides extending from the opposite ends of the lateral side, and the other side of the faceplate, respectively;

welding the first supporting spring plate to the first metallic pin at a plurality of weld points in a predetermined welding sequence by laser welding; and alternately welding the second and third supporting spring plates at a plurality of weld points respectively to the second and third metallic pins in a predetermined welding sequencee by laser welding.

2. A method of fixing a color screening structure, according to claim 1, wherein the polygonal through hole formed in the first supporting spring plate is a hexagonal through hole having three alternate sides in contact with the first metallic pin and three alternate sides spaced apart from the first metallic pin when the first metallic pin is received through the hexagonal through hole in mounting the color screening structure on the faceplate, and the polygonal through holes formed in the second and third supporting spring plates are substantially triangular through holes each having three sides which are brought into point contact with the corresponding metallic pin when the corresponding metallic pin is received therein in mounting the color screening structure on the faceplate.

3. A method of fixing a color screening structure, according to claim 2, wherein the hexagonal through hole of the first supporting spring plate is formed so that the two adjacent corners are located on a line extending in the direction of width of the first supporting spring plate.

4. a method of fixing a color screening structure, according to claim 2, wherein three weld points respectively on the sides of the hexagonal through hole of the first supporting spring plate, in contact with the first metallic pin are distributed at regular intervals of 120°, and three weld points on the sides of the hexagonal through hole of the first supporting spring plate, spaced apart from the first metallic pin are distributed at regular angular intervals of 120°.

* * * * *